US009622598B1

(12) United States Patent
Davis, Jr.

(10) Patent No.: US 9,622,598 B1
(45) Date of Patent: Apr. 18, 2017

(54) BAG HOLDER APPARATUS AND METHOD

(71) Applicant: Ronald A. Davis, Jr., Oak Run, CA (US)

(72) Inventor: Ronald A. Davis, Jr., Oak Run, CA (US)

( * ) Notice: Subject to any disclaimer, the term of this patent is extended or adjusted under 35 U.S.C. 154(b) by 0 days.

(21) Appl. No.: 14/806,869

(22) Filed: Jul. 23, 2015

(51) Int. Cl.

| | |
|---|---|
| ***A47G 29/00*** | (2006.01) |
| ***B42F 17/00*** | (2006.01) |
| ***A47F 9/04*** | (2006.01) |
| ***B65B 67/12*** | (2006.01) |
| ***A47F 13/08*** | (2006.01) |

(52) U.S. Cl.
CPC ..... *A47F 9/042* (2013.01); *A47F 13/085* (2013.01); *B65B 67/1238* (2013.01); *B65B 67/1266* (2013.01); *B65B 2067/1294* (2013.01); *Y10S 211/01* (2013.01)

(58) Field of Classification Search
CPC .. A47F 9/042; A47F 13/085; A47F 2009/044; A47F 5/0066; A47F 5/04; A47F 5/0884; A47F 9/043; A47G 23/0258; B65B 67/1233; B65B 67/1227; B65B 67/1238; B65B 67/1266; B65B 2067/1294; B65B 67/12; B65B 67/04; B65B 67/1255; B65F 1/141; B65F 1/1415; B65F 2240/138; Y10S 211/01
USPC ..... 211/12, 85.15, DIG. 1; 248/95, 97, 99, 248/100, 101; 224/925; 206/554
See application file for complete search history.

(56) References Cited

U.S. PATENT DOCUMENTS

| | | | | | |
|---|---|---|---|---|---|
| 461,291 | A * | 10/1891 | Timmerman | B65B 67/1227 | 248/100 |
| 477,235 | A * | 6/1892 | Timmerman | B65B 67/12 | 248/99 |
| 1,107,590 | A * | 8/1914 | Cupples | B65B 67/12 | 248/97 |
| 1,350,443 | A * | 8/1920 | Edstrom | B65B 67/1255 | 211/12 |
| 1,899,376 | A * | 2/1933 | Westgaard | A47F 13/085 | 211/51 |
| 2,100,235 | A * | 11/1937 | Brown | B65B 67/1227 | 248/100 |
| 3,201,072 | A * | 8/1965 | Du Bois | B60N 3/08 | 211/71.01 |
| 3,260,488 | A * | 7/1966 | Kliewer | B65B 67/1244 | 248/99 |
| 3,388,882 | A * | 6/1968 | Burroughs | B65B 67/1244 | 248/101 |
| 3,747,298 | A * | 7/1973 | Lieberman | B65B 67/1266 | 248/100 |
| 4,750,694 | A * | 6/1988 | Bateman | B65B 67/1266 | 248/175 |
| 4,830,317 | A * | 5/1989 | Kober | B65B 43/26 | 221/36 |
| 4,840,336 | A * | 6/1989 | Stroh | B65B 67/1227 | 248/175 |
| 4,869,447 | A * | 9/1989 | Malik | B65B 67/1205 | 248/97 |

(Continued)

*Primary Examiner* — Jennifer E Novosad
(74) *Attorney, Agent, or Firm* — Thomas R. Lampe

(57) ABSTRACT

Bag holder apparatus including a rigid, upstanding holder back, a handle retainer structure on the holder back and a handle releasably attached to the holder back by the handle retainer structure. The handle when removed is used to open the bag and maintain the bag in open position.

20 Claims, 5 Drawing Sheets

(56) References Cited

U.S. PATENT DOCUMENTS

RE33,122 E * 12/1989 Orem ..... A47F 9/042 186/66
5,190,253 A * 3/1993 Sable ..... B65B 67/1205 248/97
5,465,845 A 11/1995 Norby et al.
5,562,213 A * 10/1996 Wile ..... B65D 33/001 206/554
6,042,063 A * 3/2000 Kerr ..... B65B 67/1227 248/100
6,325,214 B1 * 12/2001 Smithson ..... A47F 9/042 206/554
6,367,747 B1 4/2002 Mulle
6,382,429 B1 * 5/2002 Yeh ..... A47F 9/042 206/554
6,460,814 B1 * 10/2002 Bolick ..... B65B 67/1227 248/95
7,066,389 B2 * 6/2006 Dickover ..... A47F 9/046 235/383
7,677,507 B1 3/2010 Rothbauer et al.
7,850,018 B2 * 12/2010 Galle ..... A47F 13/085 211/85.15
8,100,370 B1 1/2012 Kramer
8,381,413 B2 * 2/2013 Smith ..... F26B 25/18 211/116
8,882,061 B2 11/2014 Marsh
2006/0021956 A1 * 2/2006 Wilfong, Jr. ..... A47F 9/042 211/59.1
2006/0210200 A1 9/2006 Mikanikian
2007/0176058 A1 * 8/2007 Kohn ..... A47F 9/042 248/100
2007/0186515 A1 * 8/2007 Ruetten ..... A47F 13/085 53/502
2009/0289019 A1 * 11/2009 Alvarado ..... A47F 13/085 211/85.15
2010/0021088 A1 1/2010 Wilfong, Jr.
2010/0096514 A1 * 4/2010 Adair ..... B65B 67/1266 248/100
2010/0314507 A1 * 12/2010 Laitila ..... B65B 67/1227 248/97
2013/0146722 A1 * 6/2013 Branham ..... B65B 67/1211 248/97
2014/0138499 A1 5/2014 Laitila et al.
2015/0048039 A1 * 2/2015 Laitila ..... A47F 13/085 211/85.15
2016/0001973 A1 * 1/2016 Castro ..... B65F 1/1415 220/571

* cited by examiner

BAG HOLDER APPARATUS AND METHOD

TECHNICAL FIELD

This invention relates to bag holder apparatus and method used at checkout counters. More particularly, the bag holder apparatus is capable of holding either conventional plastic bags or reusable bags.

BACKGROUND OF THE INVENTION

Plastic bags have been widely utilized at checkout counters where bags are filled. Holders have been devised for holding a plurality of collapsed plastic bags and allowing serial dispensing thereof when the bags are employed in the bagging operation. A commonly employed type of plastic bag is the so-called T-shirt plastic bag which has apertured side handle flaps and a hole in an upper bag portion for receiving a bag hook to provide a degree of support for the bag.

There has been increasing use of more durable reusable bags. The reusable bags come in a variety of shapes and sizes and are constructed of a variety of materials. The standard bag holder structure utilized to support T-shirt plastic bags and other comparable plastic bags cannot readily be utilized with most reusable bag constructions.

As a consequence, bag holders devised specifically for retention of reusable bags have been devised. U.S. Patent Application Publication 2010/0314507, published Dec. 16, 2010 and U.S. Patent Application Publication 2014/0138499, published May 22, 2014 illustrate adjustable bag retaining apparatus comprising a hook or clamp, the hook or clamp capable of vertical sliding movement on or in a track, mast, stand, support or hollow sleeve for accommodating bags of different sizes for packing.

Other patent documents considered to be representative of the state of the art in the field of this invention are: U.S. Pat. No. 6,460,814, issued Oct. 8, 2002, U.S. Pat. No. 6,367,747, issued Apr. 9, 2002, U.S. Patent Application Publication No. US 2006/0210200, published Sep. 21, 2006, U.S. Patent Application Publication No. US 2010/0021088, published Jan. 28, 2010, U.S. Pat. No. 8,100,370, issued Jan. 24, 2012, U.S. Pat. No. 8,882,061, issued Nov. 11, 2014, U.S. Pat. No. 5,465,845, issued Nov. 14, 1995, U.S. Pat. No. 7,677,507, issued Mar. 16, 2010 and U.S. Pat. No. 6,042,063, issued Mar. 28, 2000.

DISCLOSURE OF INVENTION

The present invention relates to a bag holder system including an apparatus and a method for holding bags to keep the bags open and facilitate filling of the bags.

The apparatus is a universal bag holder since it is capable of holding either conventional plastic bags, such as T-shirt bags, or utilized to hold reusable bags of various sizes, configurations and materials.

The apparatus is characterized by its relative simplicity and reliability.

The apparatus of the system can be utilized as a stand-alone and allow for support of either plastic or reusable bags. The apparatus also can be attached to an existing conventional bag holder for plastic bags to adapt it for use with reusable bags. Several apparatus units may, if desired, be employed on a turnstile-like support.

The bag holder apparatus of the present invention is for holding bags to maintain the bags open and facilitate filling of the bags. The bag holder apparatus includes a rigid, upstanding holder back.

A handle retainer structure is on the holder back and a handle is releasably attached to the holder back by the handle retainer structure.

The handle includes a manually engageable handle portion and elongated bag engagement members extending downwardly from the manually engageable handle portion. The handle is manually removable from the handle retainer structure whereby the handle is spaced from the holder back, insertable into the interior of a bag positioned next to the holder back and manipulatable so that the elongated bag engagement members engage the inner surface of the bag to maintain the bag in open condition.

The handle is subsequently positionable into engagement with the handle retainer structure while the elongated bag engagement members are in the bag whereby the handle is reattached to the handle retainer structure and maintains the bag open and in stable upright condition adjacent to the holder back.

The method of the system includes the steps of providing a rigid, upstanding holder back and providing a handle retainer structure on the holder back.

The method also includes providing a handle including a manually engageable handle portion and elongated bag engagement members extending downwardly from the manually engageable handle portion.

The handle is inserted into the interior of a bag positioned next to the handle back.

The handle is manipulated so that the elongated bag engagement members engage the inner surface of the bag to maintain the bag in open condition.

The handle is subsequently positioned into engagement with the handle retainer structure while the elongated bag engagement members are in the bag whereby the handle is reattached to the handle retainer structure and maintains the bag open and in stable upright condition adjacent to the holder back to facilitate filling.

Other features, advantages and objects of the present invention will become apparent with reference to the following description and accompanying drawings.

MODES FOR CARRYING OUT THE INVENTION

Referring now to FIGS. 1 through 5, a first embodiment of apparatus constructed in accordance with the teachings of the present invention is illustrated. The apparatus includes a rigid, upstanding holder back 10 formed of aluminum, stainless steel or any other suitable material.

Figure 4:
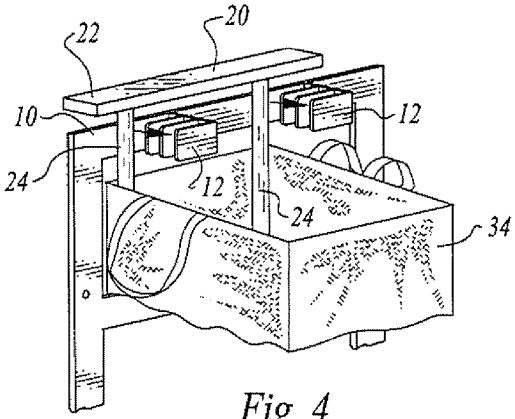
FIG. 4 is a perspective view showing a portion of the holder back, handle retainer structure in the form of two brackets attached to the holder back and a handle in the process of being positioned in the brackets, elongated bag engagement members of the handle positioned in a reusable bag, rods for entering and supporting plastic bag arms having been removed from the holder back.

Handle retainer structure is on the holder back, the handle retainer structure comprising two brackets 12, each of the brackets comprising a plurality of L-shaped tabs 14 defining a plurality of slots 16. The slots are open at the left ends of the brackets as viewed in FIGS. 1-5. A handle 20 is releasably attached to the holder back by the handle retainer structure (see FIGS. 2 and 5). FIG. 4 shows the handle in the process of being positioned in slots of the handle retainer structure brackets.

Figure 1:
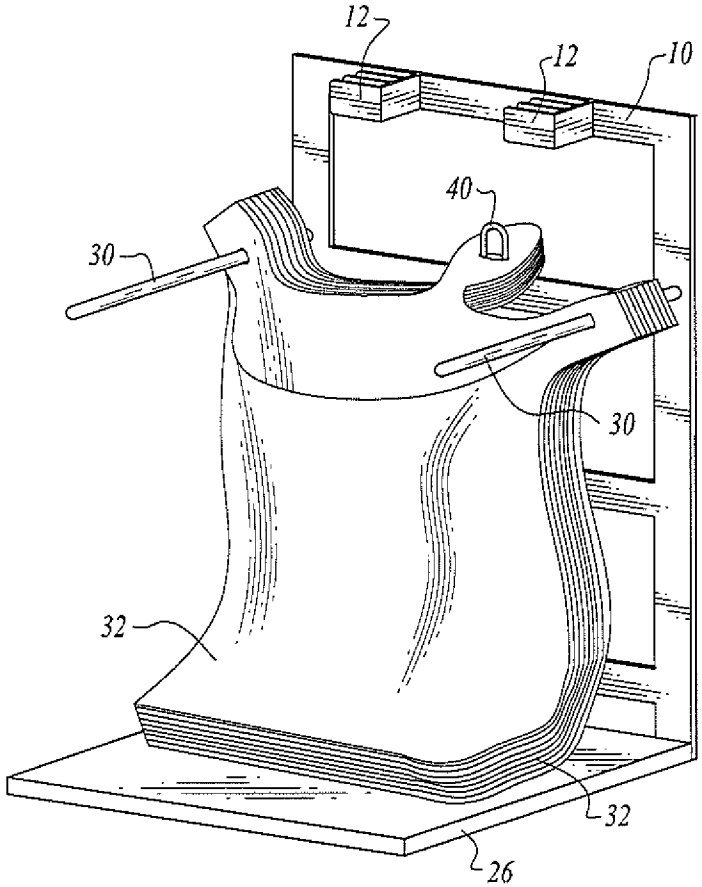
FIG. 1 is a perspective view of the holder back and selected related components of a first apparatus embodiment constructed in accordance with the teachings of the present invention utilized to support in collapsed condition a plurality of conventional T-shirt bags, a handle of the embodiment not being illustrated.
Figure 5:
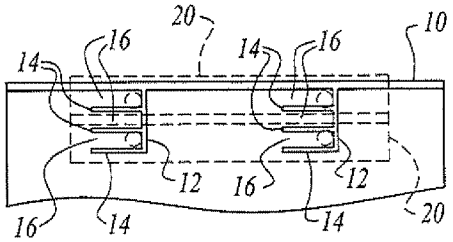
FIG. 5 is a top plan view of the holder back and brackets of the first embodiment shown in solid lines and alternative positions of the handle shown in dash lines.

The handle includes a manually engageable handle portion 22 and two elongated bag engagement members in the form of rods 24 spaced from one another and extending downwardly from the manually engageable handle portion. FIG. 5 shows in dash lines two of the three alternative positions in which the handle may be positioned. This feature allows the handle to be alternatively placed different distances from the holder back. Among other things, the ability to vary the distance between the holder back and the handle will enable a reusable bag to be supported by a base 26 connected to the holder back even while T-shirt bags are in position for use as shown in FIG. 1. Also, some adjustment of the distance between the holder back and the handle may be desirable to accommodate different sizes and configurations of reusable bags.

Figure 2:
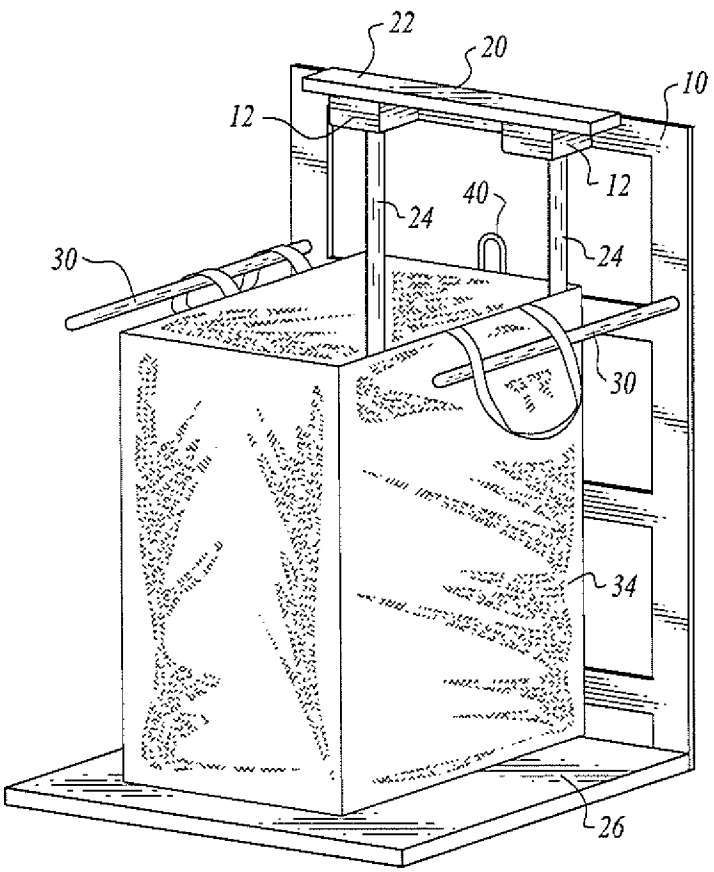
FIG. 2 is a perspective view of the first apparatus embodiment holding open and supporting a reusable bag, a handle of the apparatus being shown maintaining the bag in open condition.
Figure 3:
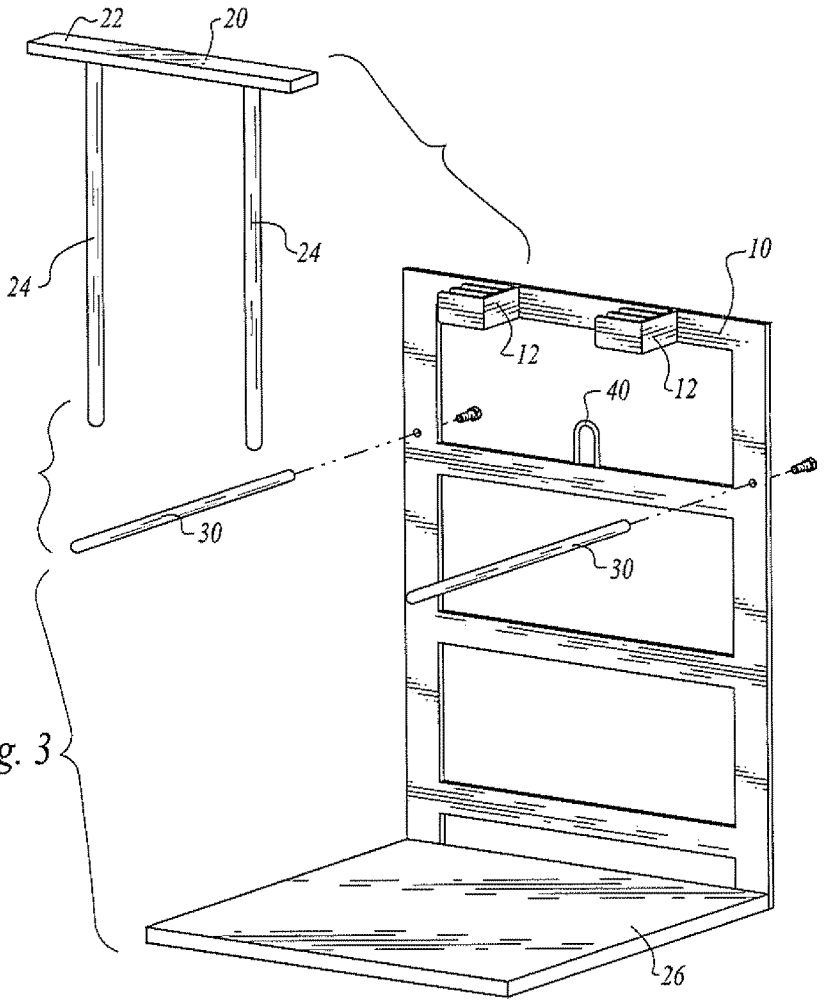
FIG. 3 is an exploded, perspective view illustrating structural components of the first embodiment of the invention prior to assembly.

As can be seen in FIG. 1, a pair of spaced, horizontally extending bag support members in the form of rods 30 project forwardly from the holder back. Rods 30 are for entering and supporting plastic bag arms of a plurality of collapsed plastic T-shirt bags 32, the rods extending from locations on the holder back below and spaced outwardly of the handle retainer structure. As shown in FIG. 3, these rods 30 are attached to the holder back by threaded fasteners. The rods 30 can be removed if desired to accommodate larger reusable bags. FIG. 2 shows a reusable bag 34 positioned on base 26 of the bag holder apparatus and it is small enough to fit between the installed rods 30. However, FIG. 4 shows the rods removed and no plastic bags supported, thus providing a bigger space allowing a wider variety and size range of reusable bags to be utilized with the bag holder apparatus. A plastic bag hook 40 may be permanently installed on the frame since it will not interfere with operation regardless of reusable bag size or shape. As shown in FIG. 1, the plastic bag hook cooperates with an upper bag portion of the plastic T-shirt bag 32 and is received by a hole in the upper bag portion.

When using the first embodiment of the bag holder apparatus, the handle 20 is manually removable from the handle retainer structure and the handle spaced from the holder bag. The elongated bag engagement members 24 are then inserted into the reusable bag 34 positioned on the base 26 next to the holder back as shown in FIG. 4. The handle is then manipulated so that the elongated bag engagement members engage the inner surface of the bag to maintain the bag in open condition. Next, the handle is subsequently positioned into engagement with the handle retainer structure brackets while the elongated bag engagement members are in the bag whereby the handle is reattached to the handle retainer structure as shown in FIG. 4 and maintains the bag open and in stable upright condition adjacent to the holder back as shown in FIG. 2.

Figure 8:
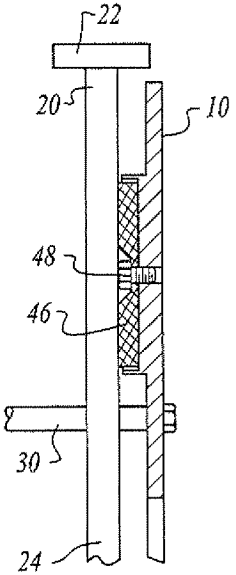
FIG. 8 is an enlarged, cross-sectional view of portions of the handle and holder back and a magnet attached to the holder back magnetically retaining the handle in place on the holder back.
Figure 7:
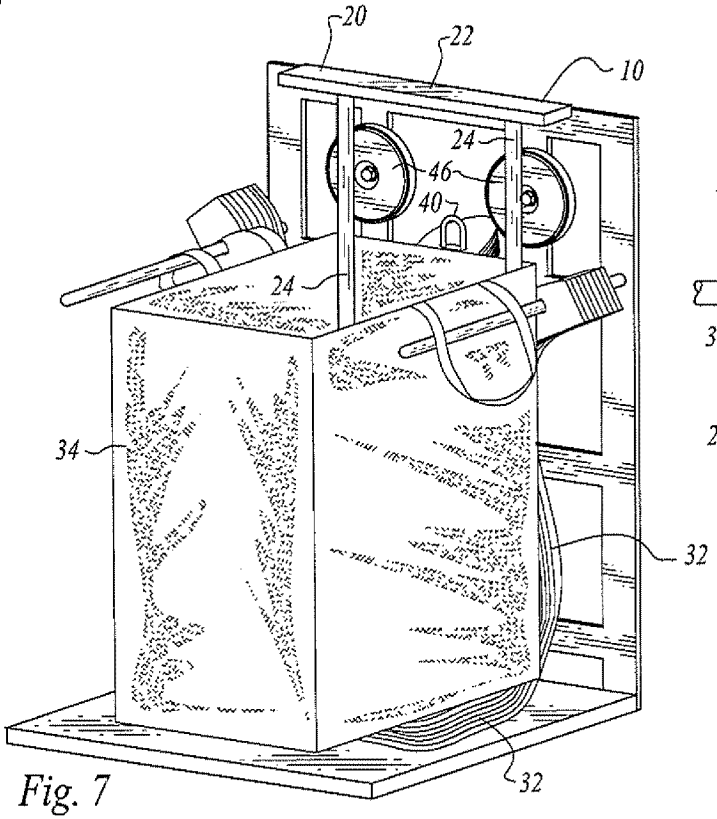
FIG. 7 is a perspective view showing the apparatus of the second embodiment of the invention assembled and supporting both a plurality of plastic T-shirt bags and a reusable bag.
Figure 6:
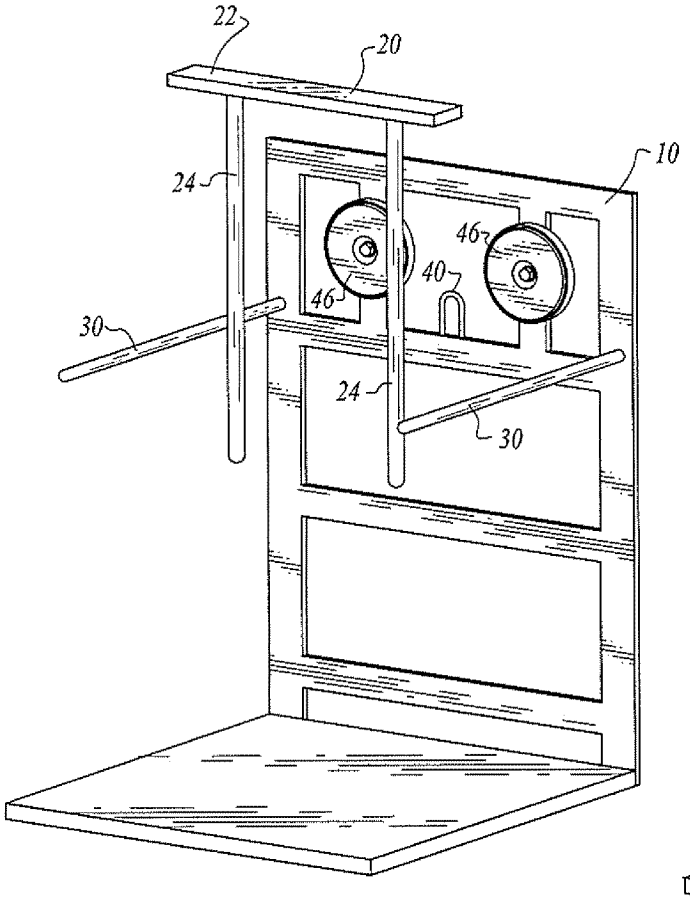
FIG. 6 is an exploded, perspective view of a second embodiment of the apparatus, the handle thereof shown in a position separated from magnets on the holder back.

FIGS. 6-8 show a second apparatus embodiment of the invention which has all structural elements of the first embodiment (said elements having like reference numerals) other than the character of the handle retainer structure on the holder back 10. In this second embodiment the handle retainer structure comprises two magnets 46 secured in place on the holder back by threaded fasteners 48. The positioning and use of the handle 20 and the other components is the same as previously described with respect to the first embodiment. In other words, in this second embodiment the handle and magnets are releasably secured together by magnetic attachment therebetween. FIG. 7 shows plastic bags 32 behind and partially under the releasable bag 34 maintained in place by the magnetic interconnection between the magnets and handle.

Figure 10:
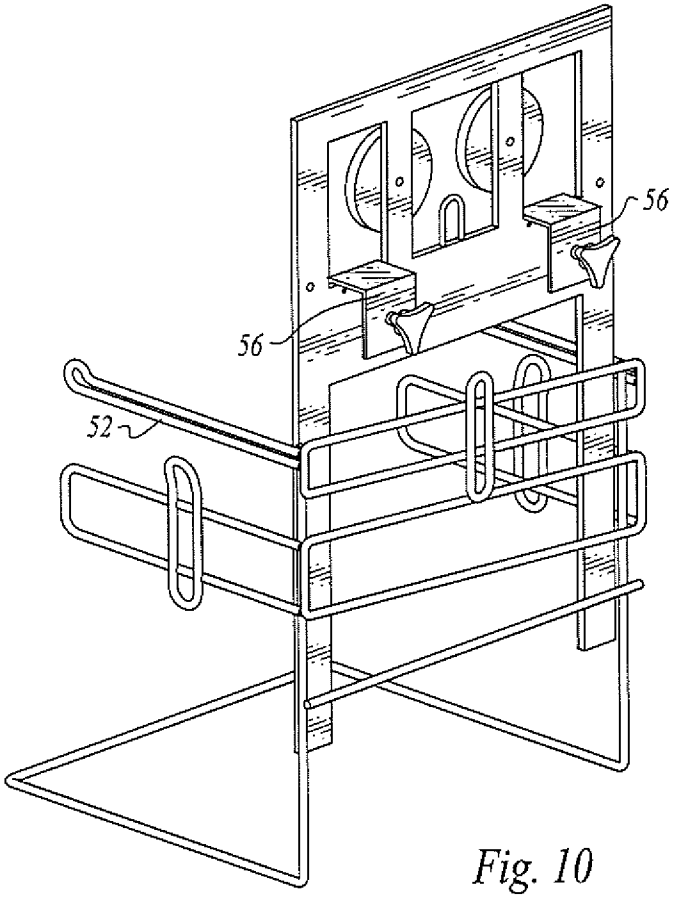
FIG. 10 is a back, perspective view of the arrangement shown in FIG. 9.
Figure 9:
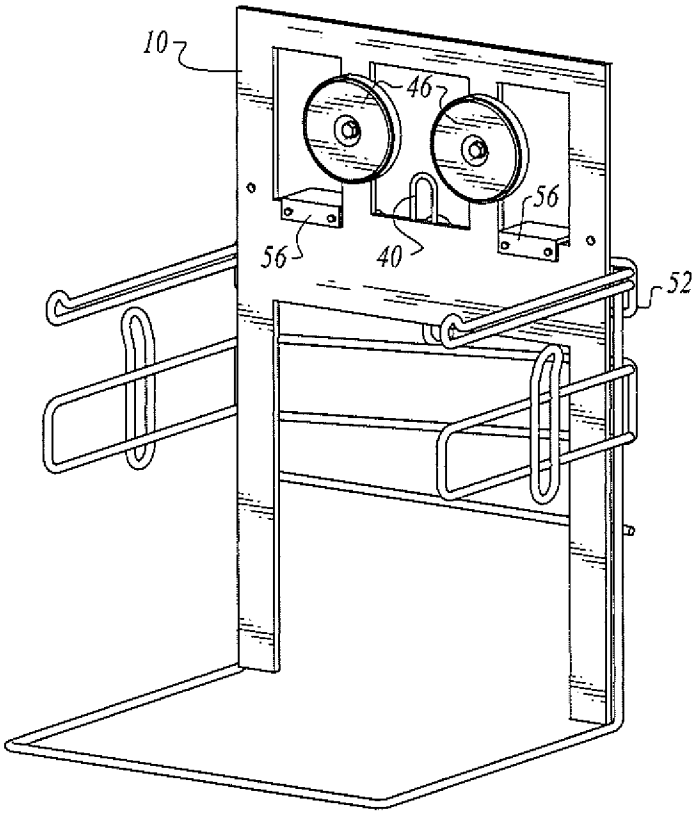
FIG. 9 is a front, perspective view of the holder back of the second embodiment attached to and extending upwardly from a conventional plastic T-shirt bag holder.

FIGS. 9 and 10 show the holder back 10 and magnets 46 without the base 26 and connected to a conventional plastic T-shirt bag holder 52. Also the horizontally extending rods used to support the plastic T-shirt bags have been removed from the holder back. The handle 20 (not shown in FIGS. 9 and 10) will operate and be utilized as disclosed above with respect to the second embodiment of the invention. Clamps 56 are utilized to releasably secure the holder back 10 in position on plastic T-shirt holder 52. FIG. 9 shows the holder back 10 and the plastic T-shirt bag holder secured together by the clamps and FIG. 10 shows the holder back and clamps being lowered into position relative to the plastic T-shirt bag holder.

Figure 11:
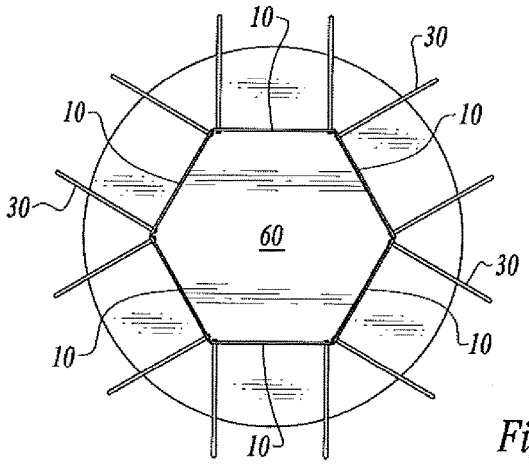
FIG. 11 is a diagrammatic plan view showing a plurality of second embodiment bag holder apparatus units attached to a turnstile-like support.
Figure 12:
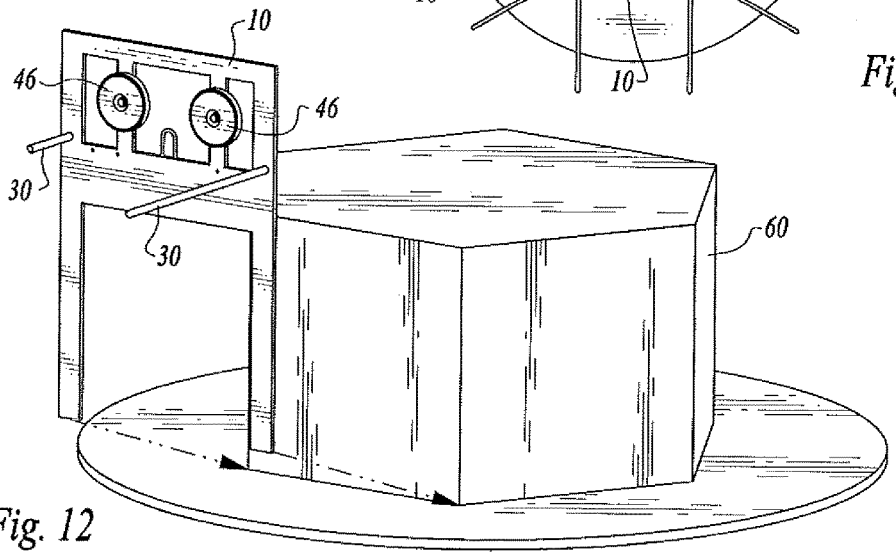
FIG. 12 is a perspective view illustrating the back plate of the second embodiment of the invention prior to placement on a section of the support.
Figure 13:
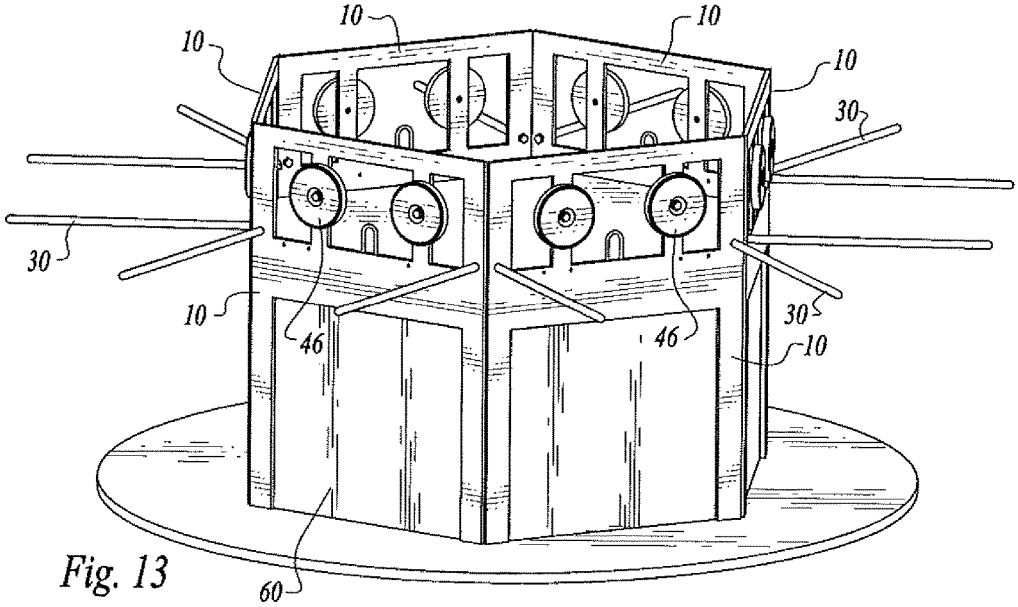
FIG. 13 is a perspective view showing six units of second embodiment bag holder apparatus attached to the support.

The embodiments of the bag holder apparatus described above can be utilized with a turnstile-like support as shown in FIGS. 11-13 and designated by reference number 60. FIG. 12 shows holder back 10 of the second embodiment being positioned in one of the support segments. FIG. 13 shows six of the holder backs in place.

The invention claimed is:

1. Bag holder apparatus for holding a bag to maintain the bag open and facilitate filling of the bag, said bag holder apparatus comprising, in combination:

a rigid, upstanding holder back;

a handle retainer structure on said holder back; and a handle releasably attached to said holder back by said handle retainer structure and including a manually engageable handle portion and elongated bag engagement members extending downwardly from said manually engageable handle portion, said handle manually removable from said handle retainer structure whereby said handle is spaced from the holder back, insertable into an interior of a bag positioned next to said holder back and manipulatable so that the elongated bag engagement members engage an inner surface of the bag to maintain the bag in an open condition, and said handle subsequently positionable into engagement with the handle retainer structure while said elongated bag engagement members are in the bag whereby the handle is reattached to said handle retainer structure and maintains the bag open and in a stable upright condition adjacent to said holder back.

2. The bag holder apparatus according to claim 1 wherein said handle retainer structure comprises at least one magnet brought into engagement with said handle establishing a magnetic attachment therebetween.

3. The bag holder apparatus according to claim 2 wherein said handle retainer structure comprises a plurality of magnets, at least two of said magnets engageable by said elongated bag engagement members.

4. The bag holder apparatus according to claim 1 additionally comprising a base connected to and supporting said holder back.

5. The bag holder apparatus according to claim 1 additionally comprising a pair of spaced, horizontally extending bag support members projecting forwardly from said holder back.

6. The bag holder apparatus according to claim 5 wherein said horizontally extending bag support members comprise rods for entering and supporting plastic bag arms of a collapsed plastic bag, said rods extending from locations on said holder back below and spaced outwardly of said handle retainer structure.

7. The bag holder apparatus according to claim 6 wherein said rods are selectively detachable from said holder back.

8. The bag holder apparatus according to claim 5 additionally comprising a plastic bag hook attached to said holder back between said rods and below said handle retainer structure.

9. The bag holder apparatus according to claim 1 wherein said handle retainer structure comprises at least one bracket attached to said holder back and defining at least one slot, said at least one bracket configured to provide a handle portion support surface and said at least one slot configured to accommodate said elongated bag engagement members.

10. The bag holder apparatus according to claim 9 wherein said handle retainer structure comprises a plurality of brackets, each of said brackets comprising a plurality of connected L-shaped tabs defining a plurality of slots, with the slots of each bracket located different distances from said holder back whereby said elongated bag engagement members and the handle portion can be positioned different distances from said holder back.

11. The bag holder apparatus according to claim 1 including an attachment structure on said holder back for connecting the bag holder apparatus to an existing plastic bag holder.

12. The bag holder apparatus according to claim 11 wherein said attachment structure comprises at least one clamp.

13. The bag holder apparatus according to claim 1 in combination with a turn-style holding additional bag holder apparatuses.

14. A method for holding A bag to maintain the bag open and facilitate filling of the bag, said method comprising the steps of:

providing a rigid, upstanding holder back;

providing a handle retainer structure on said holder back;

providing a handle including a manually engageable handle portion and elongated bag engagement members extending downwardly from said manually engageable handle portion;

inserting the handle into an interior of a bag positioned next to said holder back;

manipulating the handle so that the elongated bag engagement members engage an inner surface of the bag to maintain the bag in an open condition; and subsequently positioning the handle into engagement with the handle retainer structure while said elongated bag engagement members are in the bag whereby the handle is reattached to said handle retainer structure and maintains the bag open and in a stable upright condition adjacent to said holder back to facilitate filling.

15. The method according to claim 14 wherein said handle retainer structure comprises at least one magnet and during the step of bringing said handle into engagement with the at least one magnet, establishing magnetic attachment therebetween.

16. The method according to claim 15 wherein said handle retainer structure comprises a plurality of magnets, at least two of said magnets engageable by said elongated bag engagement members.

17. The method according to claim 14 including the additional step of providing a pair of spaced, horizontally extending bag support members projecting forwardly from said holder back.

18. The method according to claim 17 wherein said spaced, horizontally extending bag support members are rods selectively detachable from said holder back.

19. The method according to claim 14 wherein said handle retainer structure comprises a bracket structure including a plurality of connected L-shaped tabs defining a plurality of slots, with the slots defined by said L-shaped tabs located different distances from said holder back whereby said elongated bag engagement members and the handle portion can be positioned different distances from said holder back.

20. The method according to claim 14 including the step of providing an attachment structure on said holder back and employing the attachment structure to connect the holder back to an existing plastic bag holder.

* * * * *